US006643375B1

(12) United States Patent
Philp et al.

(10) Patent No.: US 6,643,375 B1
(45) Date of Patent: Nov. 4, 2003

(54) METHOD OF PROCESSING A PLURAL CHANNEL AUDIO SIGNAL

(75) Inventors: Adam Rupert Philp, Hanwell (GB); Alastair Sibbald, Maidenhead (GB); Richard David Clemow, Bucks (GB); Fawad Nackvi, Middlesex (GB)

(73) Assignee: Central Research Laboratories Limited, Hayes (GB)

( * ) Notice: Subject to any disclaimer, the term of this patent is extended or adjusted under 35 U.S.C. 154(b) by 0 days.

(21) Appl. No.: 09/185,711

(22) Filed: Nov. 4, 1998

Related U.S. Application Data

(63) Continuation-in-part of application No. 08/640,777, filed as application No. PCT/GB94/02573 on Nov. 23, 1994, now abandoned.

(30) Foreign Application Priority Data

Nov. 25, 1993 (GB) ..... 9324240

(51) Int. Cl.[7] ..... H04R 5/00
(52) U.S. Cl. ..... 381/1; 381/17; 381/310
(58) Field of Search ..... 381/1, 17, 18, 381/19, 309, 310

(56) References Cited

U.S. PATENT DOCUMENTS

| | | | | |
|---|---|---|---|---|
| 1,855,149 A | | 4/1932 | Jones | |
| 3,236,949 A | | 2/1966 | Atal et al. | |
| 3,943,293 A | | 3/1976 | Bailey | |
| 4,097,689 A | | 6/1978 | Yamada et al. | |
| 4,149,036 A | | 4/1979 | Okamoto et al. | |
| 4,192,969 A | | 3/1980 | Iwahara | |
| 4,209,665 A | | 6/1980 | Iwahara | |
| 4,219,696 A | * | 8/1980 | Kogure et al. | 381/1 |
| 4,349,698 A | * | 9/1982 | Iwahara | 381/1 |
| 4,975,954 A | | 12/1990 | Cooper et al. | |
| 4,980,914 A | | 12/1990 | Kunugi et al. | |
| 5,128,886 A | | 7/1992 | Luthra | |
| 5,136,651 A | | 8/1992 | Cooper et al. | 381/17 |
| 5,440,639 A | * | 8/1995 | Suzuki et al. | 381/17 |
| 5,715,317 A | | 2/1998 | Nakazawa | 381/17 |

FOREIGN PATENT DOCUMENTS

| | | |
|---|---|---|
| EP | 0 689 756 B1 | 10/1999 |
| GB | 394325 | 6/1933 |
| WO | 90/00851 | 1/1990 |
| WO | 94/22278 | 9/1994 |
| WO | 95/15069 | 6/1995 |

OTHER PUBLICATIONS

"Prospects for transaural Recording", Duane H. Cooper et al., J. Audio Eng. Soc., vol. 37, No. 1/2, Jan./Feb. 1989, pp. 3–19.

"Stereophonic Earphones and Binaural Loudspeakers," by B. B. Bauer, Journal of the Audio Engineering Society, vol. 9, No. 2, Apr. 1961, pp. 148–151.

* cited by examiner

*Primary Examiner*—Xu Mei
(74) *Attorney, Agent, or Firm*—Crowell & Moring LLP

(57) ABSTRACT

A method of processing a plural channel audio signal representing a three dimensional sound-field for generation by respective left and right loudspeakers arranged at a given distance from a listener, including: a) choosing a distance between said loudspeakers and said listener; b) determining from this chosen distance an optimal amount of transaural acoustic crosstalk compensation, the optimal amount being a function of the chosen distance; and c) applying said optimal amount of crosstalk compensation to said left and right channels. The optimal transaural crosstalk cancellation is preferably achieved using a near ear response transfer function and a far ear response transfer function which asymptotically approach different values at low frequencies. The method may further include choosing an angle between the left channel loudspeaker and the right channel loudspeaker, and determining from both the chosen angle and the chosen distance an optimal amount of transaural crosstalk compensation.

8 Claims, 10 Drawing Sheets

Calculation of distance between source and far-ear in the near space area (2 m diameter) around the listener's head in the horizontal plane (left), showing detail of the tangential and circumferential paths (right).

Figure 1:
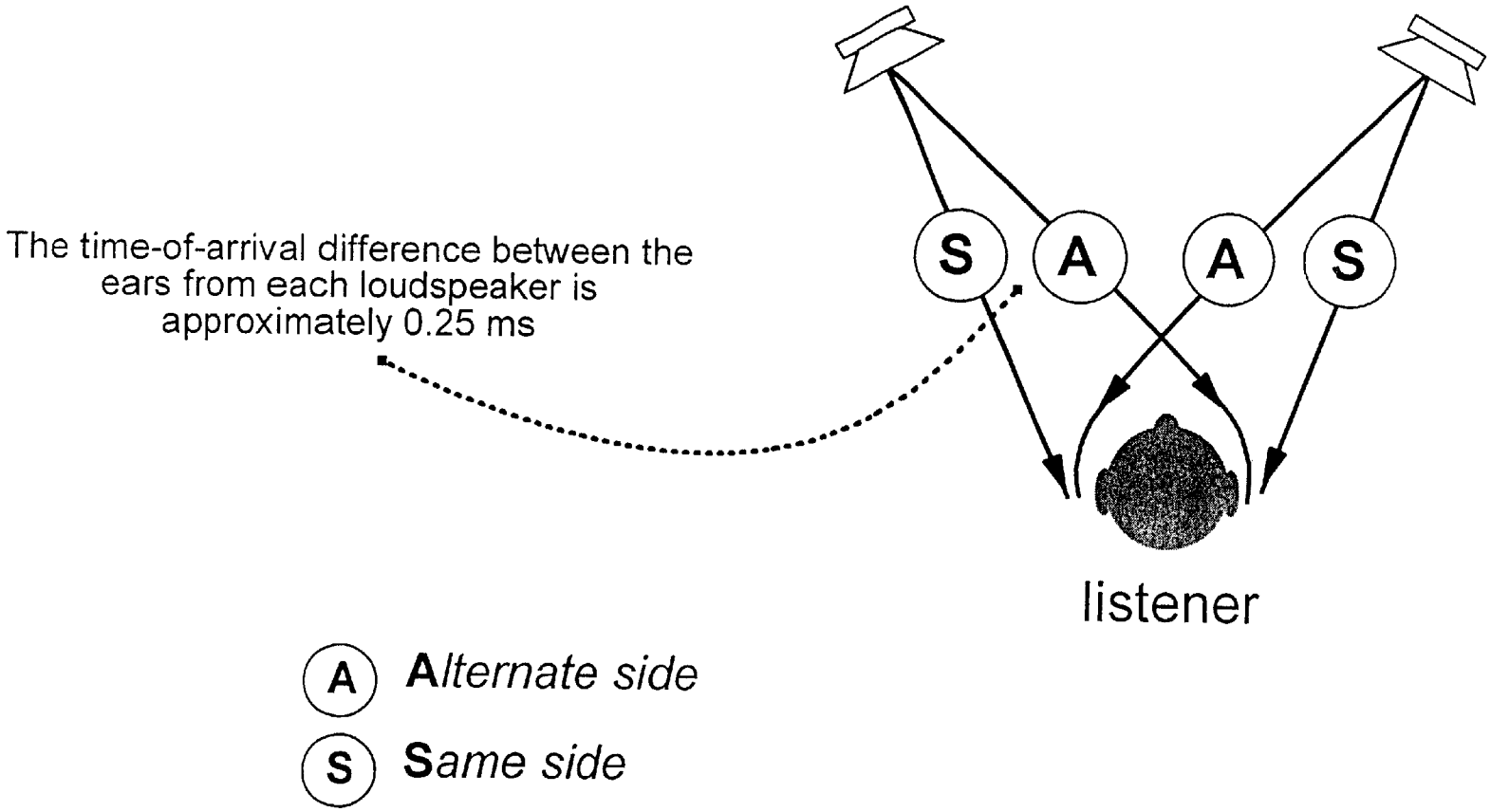

Figure 1: Transfer functions when listening to two-speaker stereo

Figure 2:
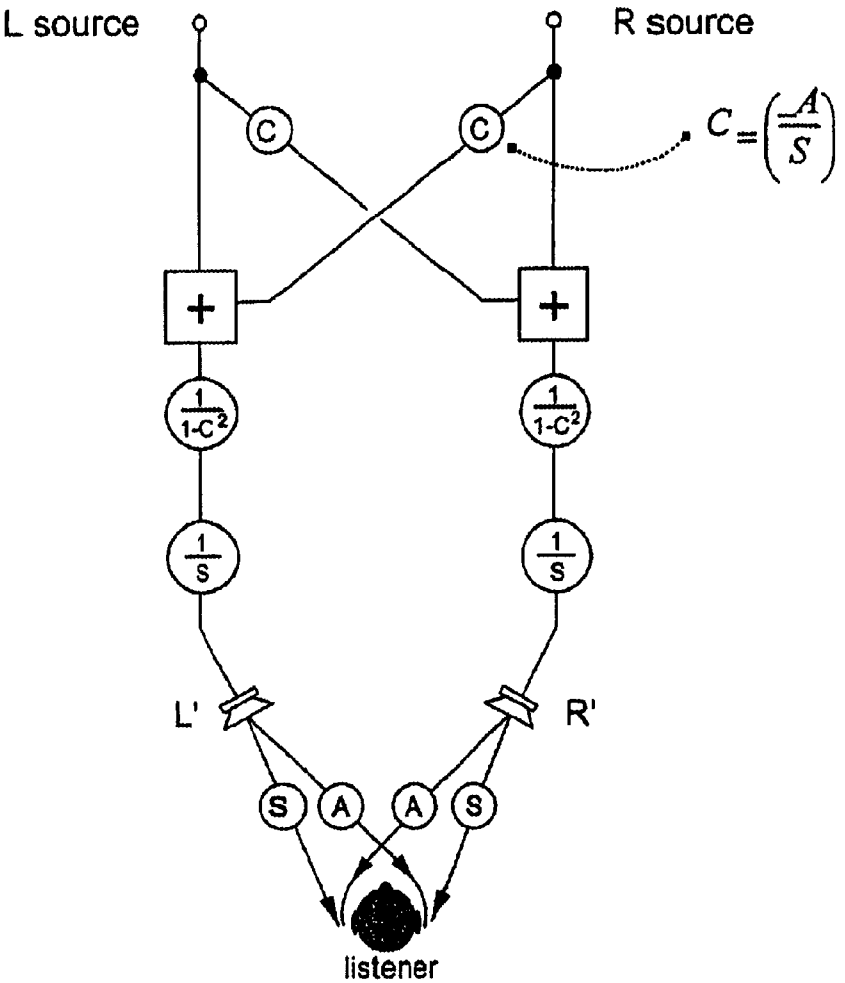

Figure 2: Typical prior-art transaural crosstalk cancellation scheme (Schroeder).

Figure 3:
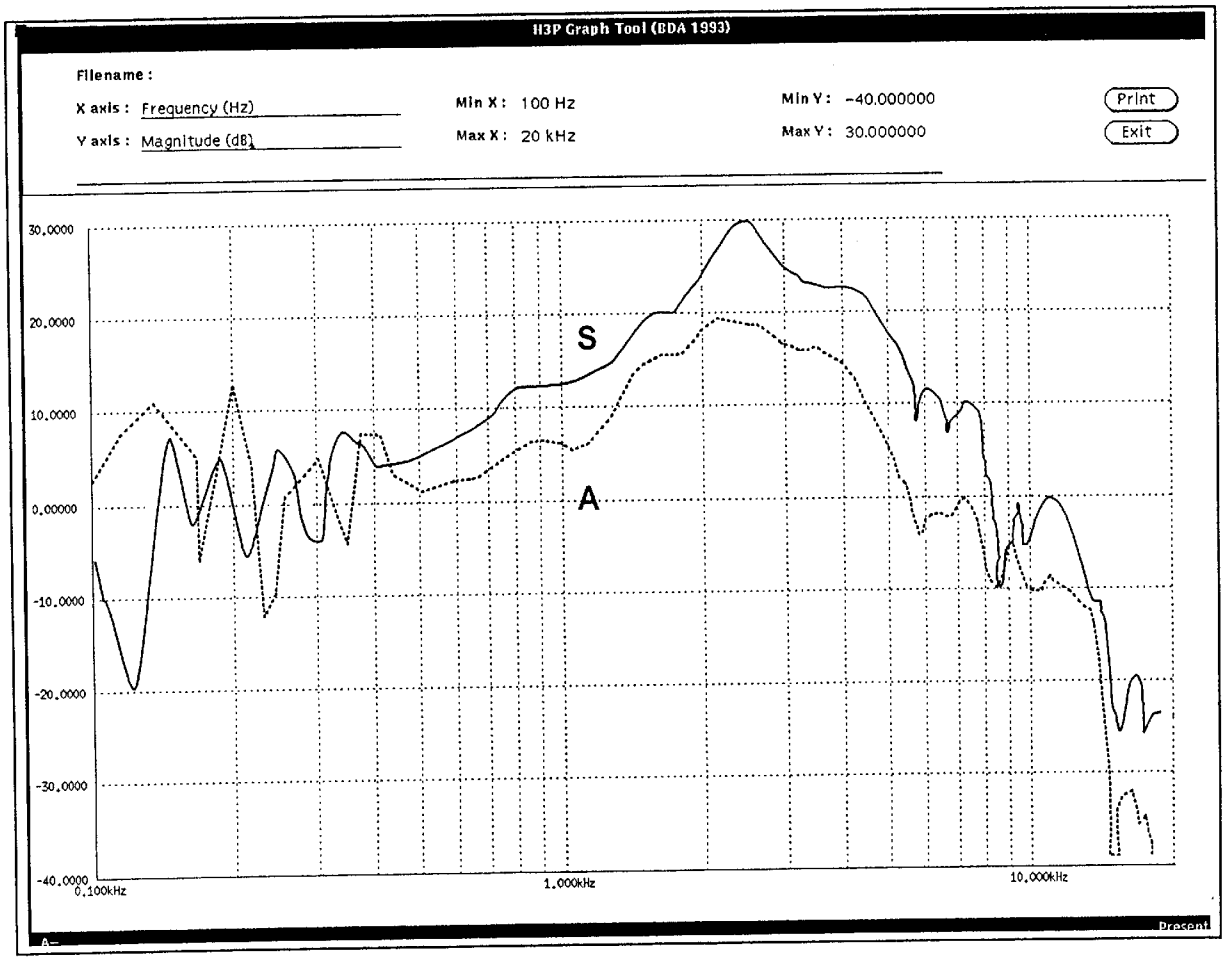

Figure 3: Typical A and S functions measured from an artifical head, showing uncertainty of data below 200 Hz.

Figure 4:
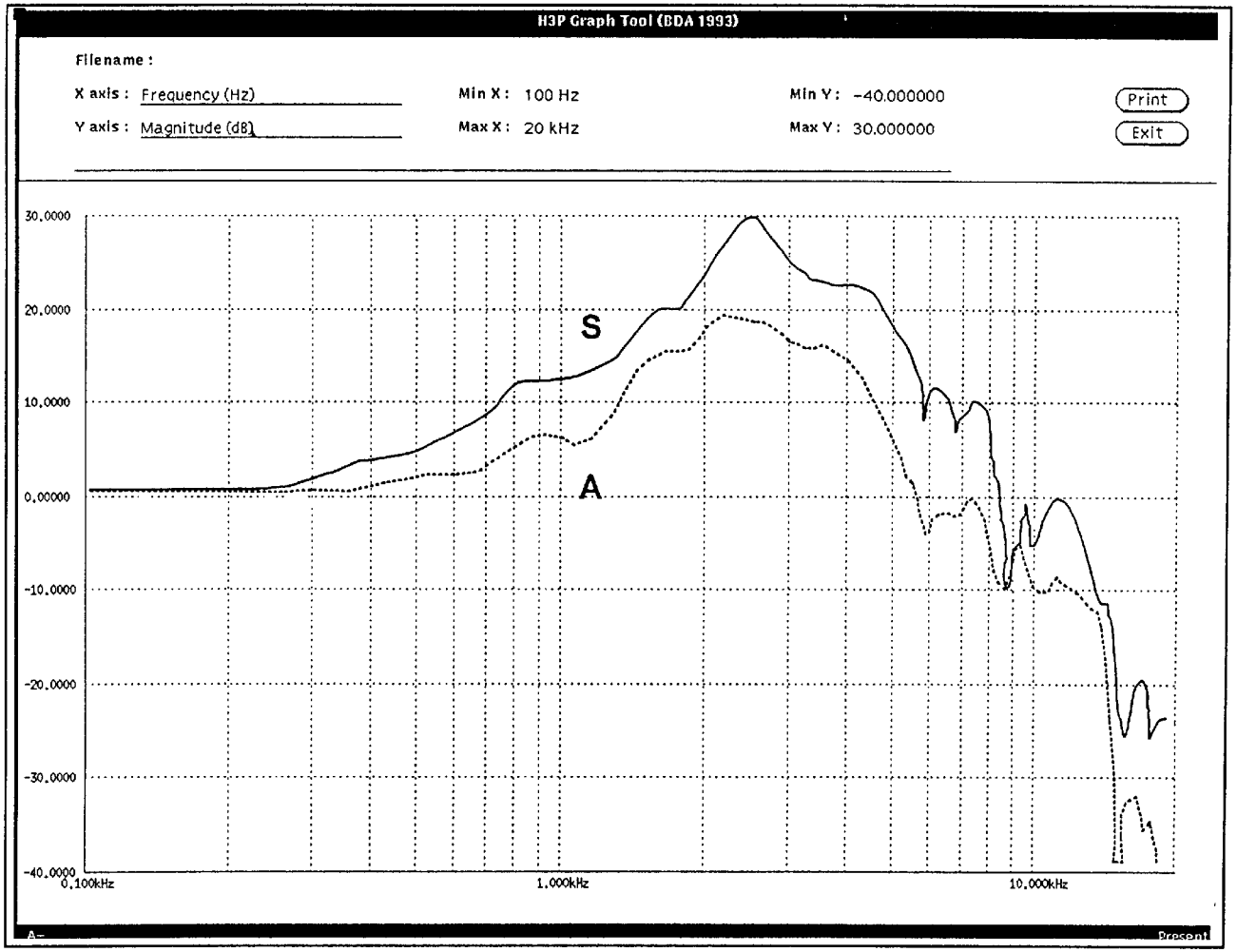

Figure 4: Typical A and S functions with forced LF convergence below 200 Hz.

Figure 5:
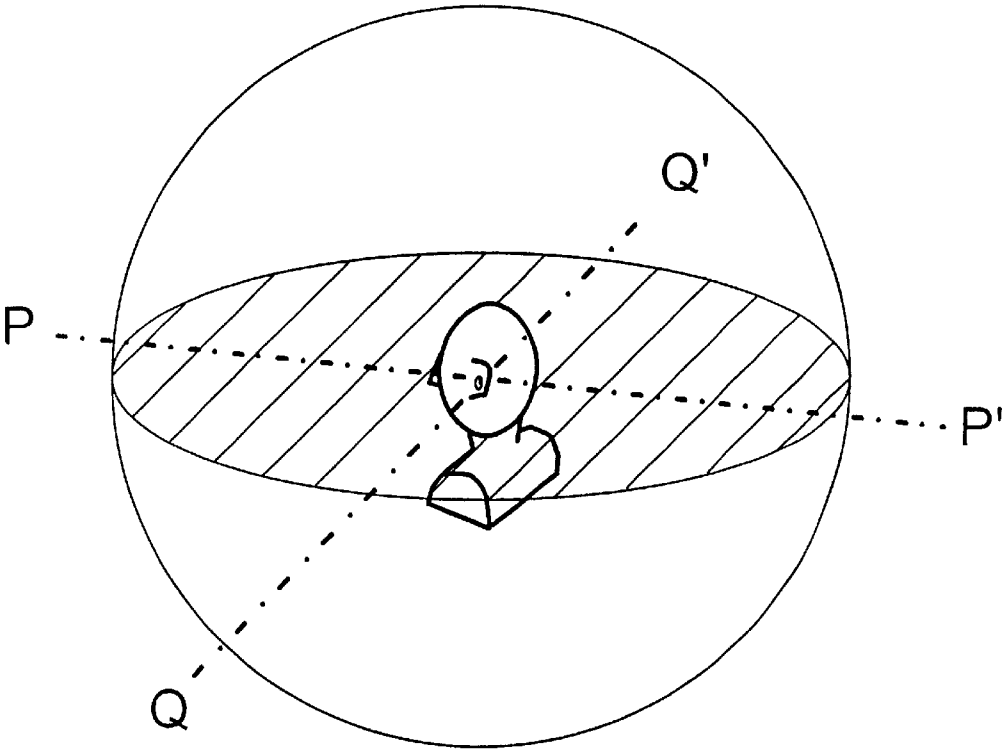

Figure 5: Reference sphere and co-ordinate system.

Figure 6:
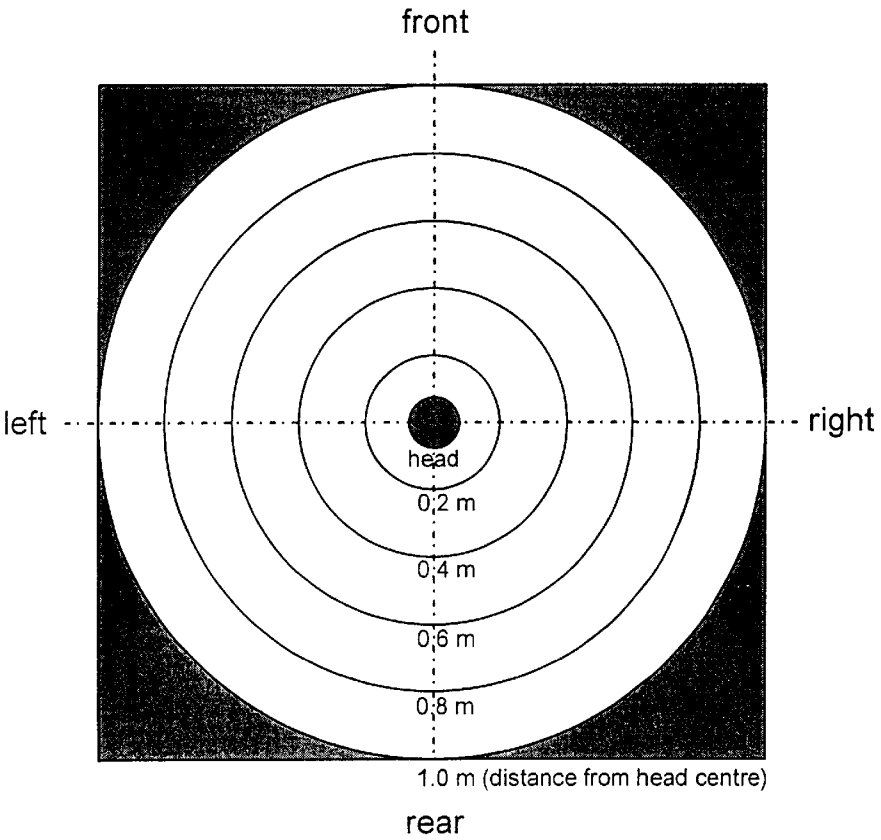

Figure 6: Plan diagram of the near space area (2 m diameter) around listener's head in the horizontal plane (head diameter is 0.15 m).

Figure 7:
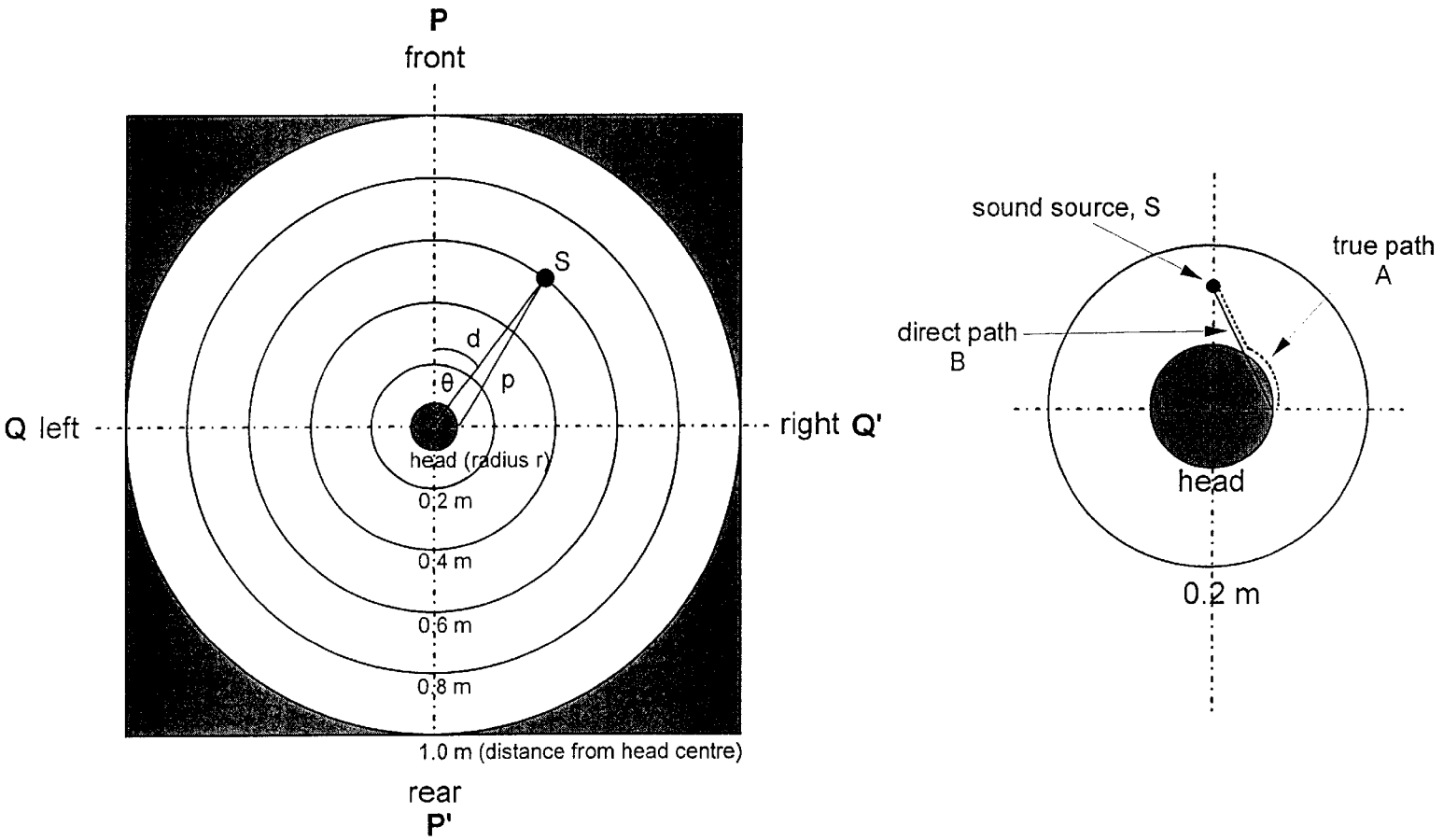

Figure 7: Calculation of distance between source and near-ear in the near space area (2 m diameter) around the listener's head in the horizontal plane (left), showing the direct path approximation for close frontal sources (right).

Figure 8:
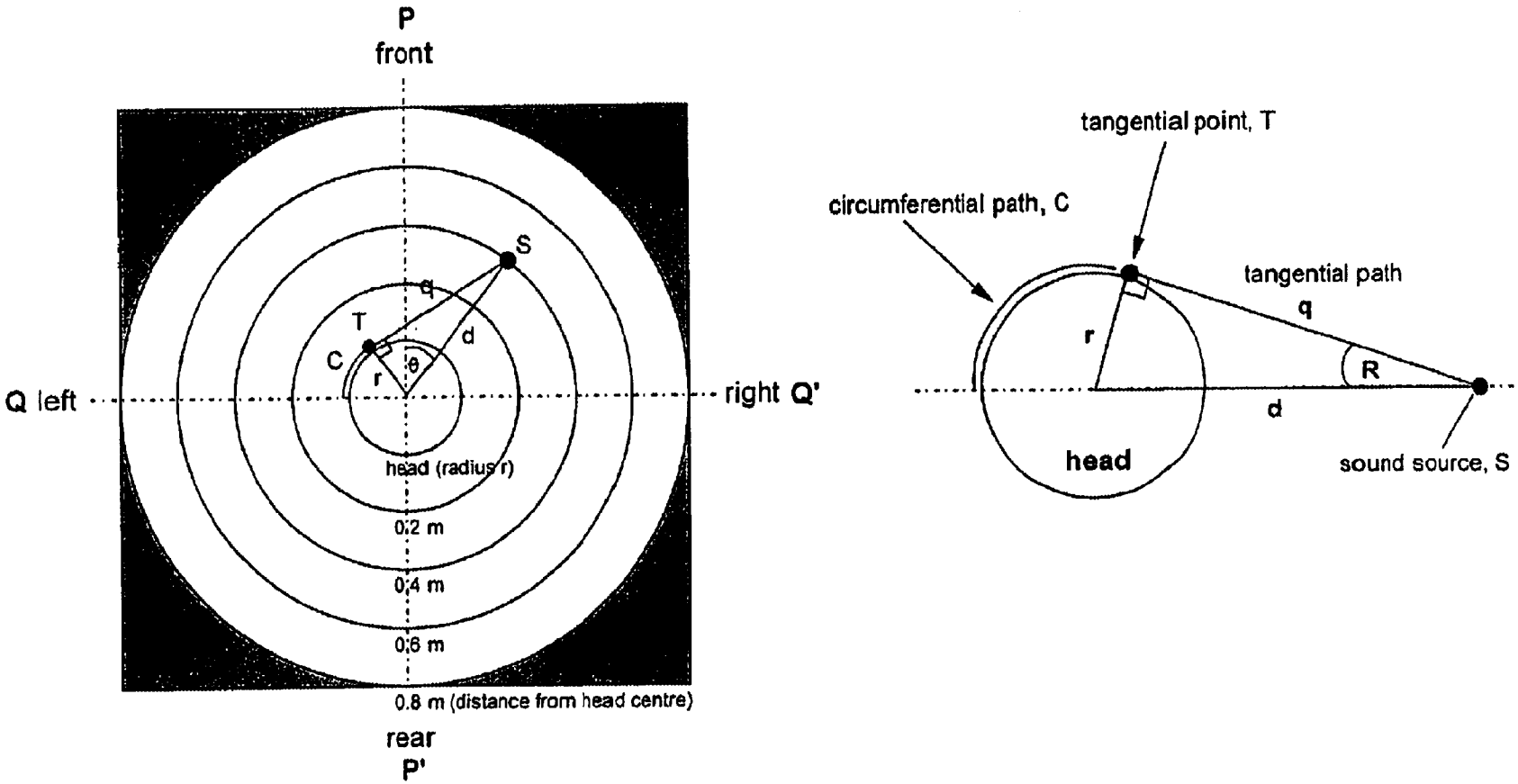

Figure 8: Calculation of distance between source and far-ear in the near space area (2 m diameter) around the listener's head in the horizontal plane (left), showing detail of the tangential and circumferential paths (right).

Figure 9:
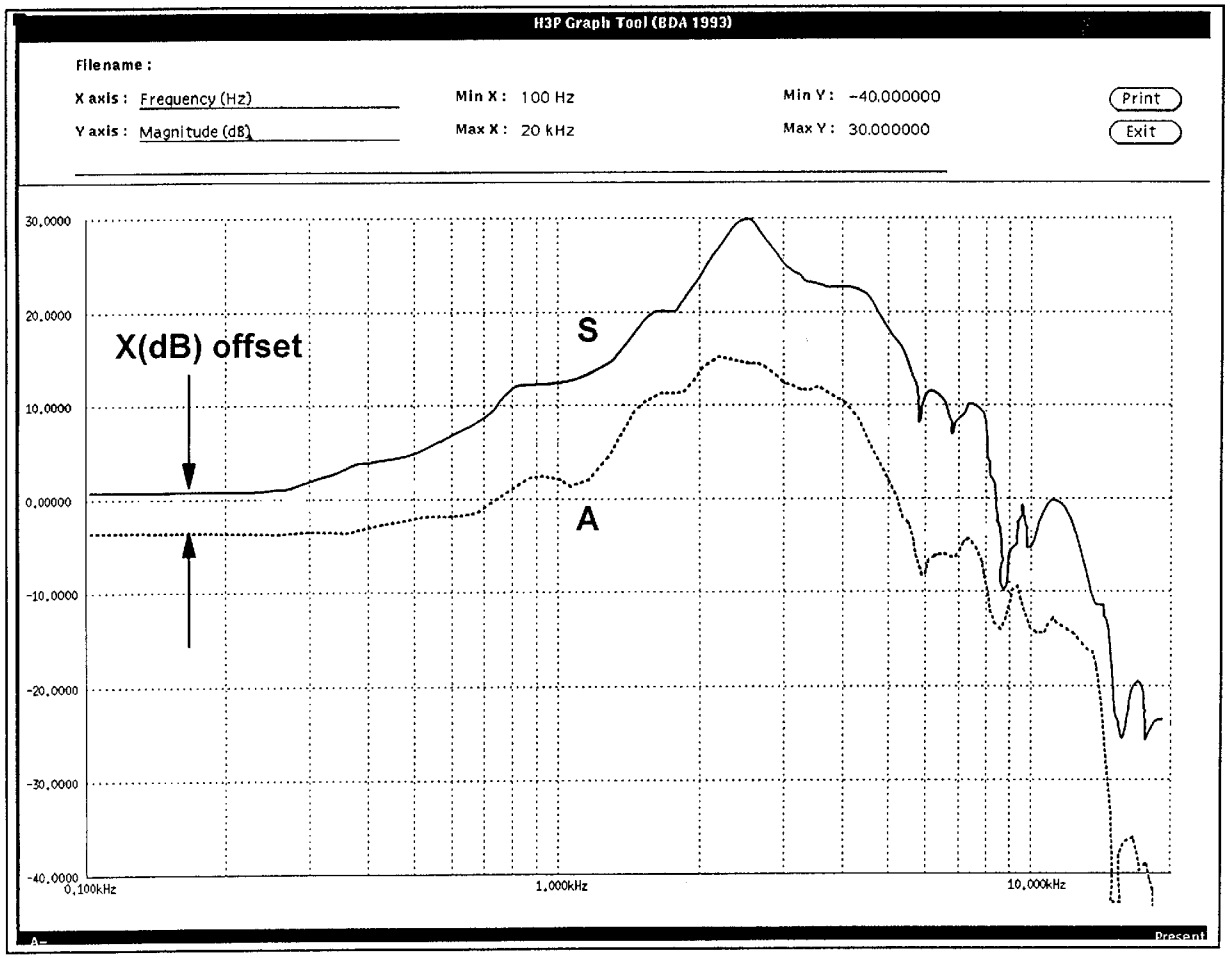

Figure 9: A and S functions with LFseparation according to the transaural crosstalk cancellation factor, X(dB).

3D Surface Plot of Transaural Crosstalk Cancellation Factor for Various Speaker Angles and Distances

METHOD OF PROCESSING A PLURAL CHANNEL AUDIO SIGNAL

This application is a continuation-in-part application based upon application Ser. No. 08/640,777, filed May 21, 1996 now abandoned, which is a 371 of PCT/GB94/02573, filed Nov. 23, 1994, application WO 95/15069.

The invention relates to a method of processing a plural channel audio signal including left and right channels, the information in the channels representing a three dimensional sound-field for generation by respective left and right loudspeakers arranged at a given distance from the preferred position of a listener in use.

The processing of audio signals to reproduce a three dimensional sound-field on replay to a listener having two ears has been a goal for inventors for many years. One approach has been to use many sound reproduction channels to surround the listener with a multiplicity of sound sources such as loudspeakers. Another approach has been to use a dummy head having microphones positioned in the auditory canals of artificial ears to make sound recordings for headphone listening. An especially promising approach to the binaural synthesis of such a sound-field has been described in EP-B-0689756, which describes the synthesis of a sound-field using a pair of loudspeakers and only two signal channels, the sound-field nevertheless having directional information allowing a listener to perceive sound sources appearing to lie anywhere on a sphere surrounding the head of a listener placed at the centre of the sphere.

The goal of researchers developing and studying the synthesis of 3D sound-fields from conventional two speaker systems has been to provide for complete and effective transaural crosstalk cancellation.

The fundamental Head Response Transfer Function (HRTF) characteristics which are required to implement a transaural acoustic crosstalk cancellation scheme are the left- and right-ear transfer functions associated with the azimuth angle at which the loudspeakers are situated (FIG. 1). For most applications, this is commonly accepted to be ±30°. The near-ear function is sometimes referred to as the "same" side function (or "S" function), and the far-ear function as the "alternate" (or "A") function. These A and S characteristics form the basis of all transaural acoustic crosstalk cancellation schemes (FIG. 2). Transaural acoustic crosstalk cancellation is described in more detail in WO 95/15069, which is incorporated herein by reference, and from which application the present application is a continuation-in-part. The A and S functions are combined to form filter blocks of the form:

$$\left(\frac{1}{1-C^2}\right) \tag{1}$$

(where C=(−A/S)), and:

$$\left(\frac{1}{S}\right) \tag{2}$$

These terms are often compounded together and simplify to form:

$$\left(\frac{S}{S^2-A^2}\right) \tag{3}$$

It is not possible to obtain reliable measurements of HRTF data (A and S) at low frequencies for several reasons, including the following.

1. Poor LF Response of Measurement Actuator (Loudspeaker)

In practise, it is known to make measurements from an artificial head in order to derive a library of HRTF data. It is common practise to make these measurements at distances of 1 meter or thereabouts, for several reasons. Firstly, the sound source used for such measurements is, ideally, a point source, and usually a loudspeaker is used. However, there is a physical limit on the minimum size of loudspeaker diaphragms. Typically, a diameter of several inches is as small as is practical whilst retaining the power capability and low-distortion properties which are needed. Hence, in order to have the effects of these loudspeaker signals representative of a point source, the loudspeaker must be spaced at a distance of around 1 meter from the artificial head. (As it is often required to create sound effects for PC games and the like which possess apparent distances of several meters or greater, and so, because there is little difference between HRTFs measured at 1 meter and those measured at much greater distances, the 1 meter measurement is used.) However, loudspeakers of this size and configuration possess very poor LF performance, and their LF response begins to fail at frequencies of around 200 Hz and below.

2. Poor LF Response of Measurement Sensor (Microphone in Artificial Head)

3. DC Offsets in Instrumentation

It is not uncommon to find spurious DC level offsets of 5–10 mV in digital tape recorders and other instruments used in HRTF measurements. (A DC offset corresponds directly to a gain error at 0 Hz.)

4. Wind Pressure Artefacts

In an anechoic measurement chamber, external wind pressure can cause significant pressure fluctuations within the chamber, giving rise to substantially large data offsets. Consequently, it is convenient to filter off the LF components of the HRTF signals prior to recording them, thus making the mid and high frequency information reliable and reproducible, but at the expense of loss of LF data.

5. Standing Waves

Even in an anechoic chamber, residual reflected energy can combine to cause standing waves. and these are most apparent at long wavelengths, hence procedures used for (4), above are doubly useful.

6. Impulse Measurement Method

HRTFs are measured by means of impulse responses, and this measurement does not provide LF data, because there is insufficient energy in the transient impulse below around 200 Hz. Even when a "stretch" pulse method is used, this is still the case.

7. Time Domain Windowing

When measuring HRTFs, it is essential to "window" the measured impulses in the time domain to a period of several milliseconds in order to eliminate incorporating reflected waves into the measurement (even in an anechoic chamber), and this cuts off the spectrum of the resultant data, again, below around 200 Hz.

As a consequence, HRTFs measured by the prior art methods do not contain LF information, although, of course, the LF response is present in reality. The results of a typical HRTF measurement are shown in FIG. 3, depicting the A and S functions at 30° azimuth, measured from a commercial artificial head. The uncertainty in the non-valid data, below several hundred Hz, is apparent. Accordingly, the missing LF properties must be replaced in order to create valid HRTFs, and this is conveniently done by extrapolating the amplitude data at the lowest valid frequency (200 Hz) back to 0 Hz (or in practise, back to the lowest practical frequency, say 10 Hz). However, although the LF amplitude data do not contain a great deal of "detail" (unlike the HF characteristics), and therefore it might be supposed that back-extrapolation might be simple, it is not entirely straightforward. This is because the HRTF curves are not flat at the lowest valid frequency, but still curving, and the near- and far-ear characteristics exhibit slightly differently shaped curves. Consequently, one must make an intelligent estimate of the y-axis intercept, and extrapolate both curves accordingly, as is shown in FIG. 4. Any LF errors can create significant quality problems, as low-frequency artefacts are very noticeable in high quality audio applications, often termed "phase errors". For this reason any LF errors in the processing must be avoided), and so in practice both near- and far-ear characteristics of the HRTF are extrapolated to the same value at low frequencies.

Prior art transaural crosstalk cancellation methods have always used A and S functions which tend to the same value at low frequencies (see for example, Atal and Schroeder, U.S. Pat. No. 3,236,949). Using such functions, the anticipated crosstalk signal at the far ear is equal to the primary signal at the near ear at low frequencies, hence the ratio of crosstalk signal to primary signal is always 1:1 at low frequencies.

According to a first aspect of the invention there is provided a method A method of processing a plural channel audio signal including left and right channels, the information in the channels representing a three dimensional sound-field for generation by respective left and right loudspeakers arranged at a distance from the preferred position of a listener in use, the method including:

a) choosing a distance between said loudspeakers and said preferred position;

b) determining from the magnitude of this chosen distance an optimal amount of transaural acoustic crosstalk compensation, said optimal amount being a function of the chosen distance; and c) applying said optimal amount of crosstalk compensation to said left and right channels.

Preferably, the method further includes choosing an angle between the left channel loudspeaker and the right channel loudspeaker as viewed from said preferred position, and determining from both said chosen angle and said chosen distance an optimal amount of transaural acoustic crosstalk compensation, said optimal amount being a function of both the chosen angle and the chosen distance.

According to a second aspect of the invention there is provided Transaurual acoustic crosstalk filter means being constructed and arranged for performing the said method. According to a third aspect of the invention there is provided an audio signal produced by said method. A further aspect of the invention provides apparatus according to claims 8 and 9.

Figure 10:
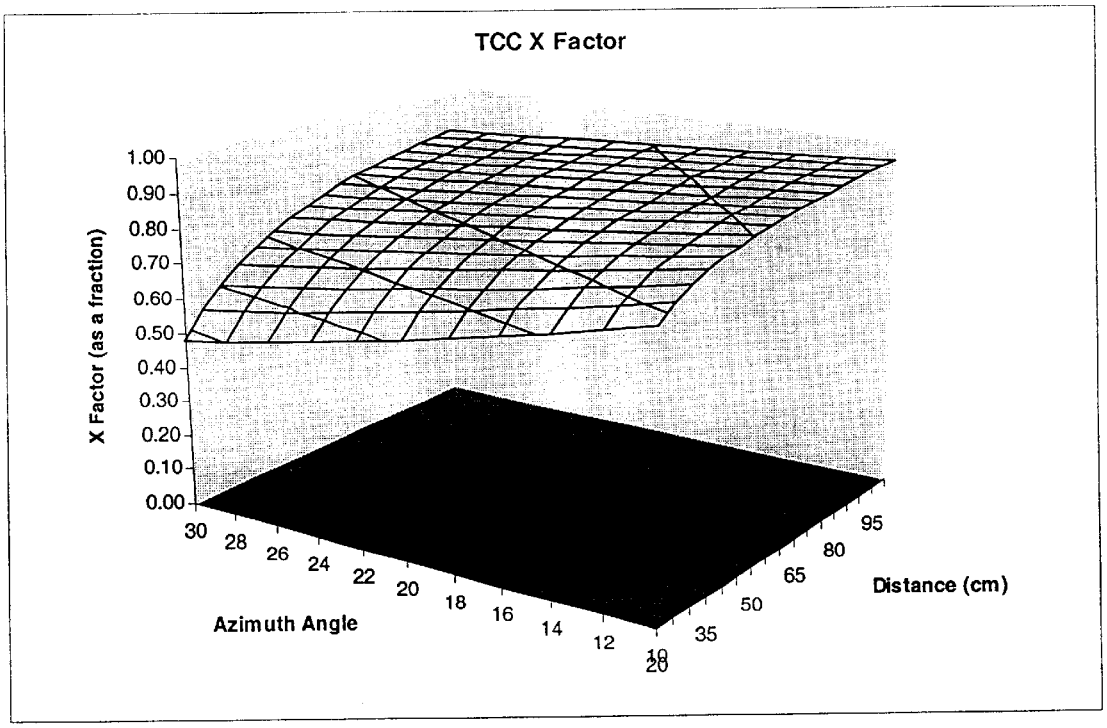

Embodiments of the invention will now be described, by way of example only, with reference to the accompanying diagrammatic drawings, in which:

FIG. 1 shows a plan view of a listener, loudspeakers, and transfer functions, FIG. 2 shows a prior art transaural acoustic crosstalk cancellation scheme, FIG. 3 shows typical experimentally measured A and S functions, FIG. 4 shows prior art modified A and S functions with forced convergence below 200 Hz, FIG. 5 shows a listener with reference sphere and co-ordinate system, FIG. 6 shows a plan view of the space around the listener in the horizontal plane, FIG. 7 shows how near ear distances are calculated in the horizontal plane, FIG. 8 shows how far ear distances are calculated in the horizontal plane, FIG. 9 shows A and S functions according to the present invention, and FIG. 10 shows the transaural crosstalk cancellation factor (X) as a function of speaker angle and distance in the horizontal plane.

The inventor of the present invention has discovered that the amount of transaural crosstalk which actually occurs, relative to the primary signal, is dependent upon the distance of the loudspeakers from the listener (and this distance dependency is also a function of azimuthal position). In the present description and claims the term "transaural crosstalk" is defined to be the intensity ratio of the far ear signal with respect to the near ear signal. As these two functions have a different frequency dependence, this ratio will in general be a function of frequency. However, in the prior art the ratio approaches unity at low frequencies because A and S are forced to the same value below about 200 Hz. That is, the transaural crosstalk signal (far ear signal) is equal in magnitude to the primary signal (near ear signal) for such low frequencies. Hence it can be said that in all the prior art schemes the transaural crosstalk signal is substantially equal to (100% of) the primary signal at low frequencies, regardless of loudspeaker distance and/or angle. Consequently, all the prior art methods of transaural crosstalk cancellation have not been optimal for the arrangements/distances of loudspeakers used in practice.

The invention provides a means for creating optimal transaural crosstalk cancellation particularly, though not exclusively, for users of Personal Computer (PC)—based multimedia systems, in which the loudspeakers are relatively close to the listener and might be at a variety of differing angles and distances, depending on the individual user's set-up configuration and preferences. The amount of transaural crosstalk which occurs is also influenced by the angle of the loudspeakers. (Note that this is not to be confused with the use of the appropriate azimuth angle A and S functions, which is well known: i.e. use 30° A and S unctions for speakers at 30°; 15° A and S functions for speakers at 15°, and so on).

This realisation enables the precise calculation of the relative transaural crosstalk intensity which occurs for any given loudspeaker distance and angle, which result can in turn be used to control the amount of transaural crosstalk cancellation which is implemented. WO 95/15069 described a method which provided improved transaural crosstalk cancellation by reducing the amount of cancellation to around 95% for hi-fi distanced loudspeakers. This was based on subjective testing at a speaker distance of 2.5 meters, in that this value provided the best audio results in critical listening tests, but it was not clear at the time exactly why this should be so. The present discovery explains this earlier result, and in fact shows that the theoretical optimum value (see Table 1) for the above testing was 94%, thus confirming the subjective assessment that "about 95% cancellation" was best.

It is standard procedure (as described in WO/15069) to use A and S functions which are artificially "forced" to converge at several hundred Hz and be virtually identical at frequencies below this value. As a result of this, as noted before, the anticipated transaural crosstalk signal will be equal to the primary signal at low frequencies, resulting in "100%" transaural crosstalk cancellation. Such 100% transaural crosstalk cancellation would be appropriate for loudspeakers which are infinitely distant. It is also a reasonably good approximation for speakers which are several meters away from the listener, such as in a conventional hi-fi arrangement. However, at distances closer than several meters, a 100% cancellation signal is significantly excessive and therefore the transaural crosstalk is "over cancelled": it not cancelled properly. Hence the overall effectiveness is reduced. This has not previously been recognised.

The present invention is a transaural crosstalk cancellation means based on "standard", 1 meter A and S functions. The method employs an algorithm which controls the intensity of the transaural crosstalk cancellation signal relative to the near-ear intensity, using a crosstalk cancellation factor which is a function of loudspeaker proximity and spatial position. The invention is based on the observation that when a sound source moves relatively closely towards the head (say, from a distance of several meters), then the individual far- and near-ear properties of the HRTF do not change a great deal in terms of their spectral properties, but their amplitudes, and the amplitude difference between them, do change substantially, caused by a distance ratio effect.

For practical reasons, it is useful to consider the typical range of loudspeaker position angles and distances representative of present multimedia loudspeaker configurations. Such loudspeaker azimuthal angles lie in the range ±10° (for notebook PCs) to ±30° (for desktop PCs), and the distances (loudspeaker to ear) range from about 0.2 meters to 1 meter respectively. These ranges will be used here for illustrative purposes, but of course the invention is not restricted to these parameters.

As a general illustration of the effects of using a relatively close loudspeaker, first consider the approximate relative intensities at the far- and near-ear. When a lateral sound source moves towards the head from, say, 1 meter distance, the distance ratio (far-ear to sound source vs. near-ear to sound source) becomes greater. For example, at 45° azimuth in the horizontal plane, at a distance of 1 meter from the centre of the head, the near ear is about 0.95 meter distance and the far-ear around 1.06 meter. So the distance ratio is (0.95/1.06)=0.90. When the sound source moves to a distance of 0.5 meter, then the ratio becomes (0.45/0.57)=0.79, and when the distance is only 20 cm, then the ratio is approximately (0.16/0.27)=0.59. The intensity of a sound source diminishes with distance as the energy of the propagating wave is spread over an increasing area. The wavefront is similar to an expanding bubble, and hence the energy density is related to the surface area of the propagating wavefront, which is related by a square law to the distance travelled (the radius of the bubble). This is described in the Appendix. Hence the intensity ratios of left and right channels are related to the ratio of the squares of the distances. Hence, the intensity ratios for the above examples at distances of 1 m, 0.5 m and 0.2 m are approximately 0.80, 0.62 and 0.35 respectively. In dB units, these ratios are −0.97 dB, −2.08 dB and −4.56 dB respectively.

It is important to note, however, that the far ear to near ear intensity ratio differences are position dependent. For example, if the aforementioned situation were repeated for a frontal sound source (azimuth 0°) approaching the head, then there would be no difference between the left and right channel intensities, by symmetry. In this instance, the intensity level of both channels simply would increase according to the $1/R^2$ law.

Accordingly, it is desirable to derive an expression which defines the relative intensity ratio at the far- and near-ears, caused by a local sound source, as a function of both the distance and angular position of the source relative to the listener. As a frame of reference, FIG. 5 shows a diagram of the near space around the listener, together with the reference planes and axes which will be referred to during the following descriptions, in which P–P' represents the front-back axis in the horizontal plane, intercepting the centre of the listener's head, and with Q–Q' representing the corresponding lateral axis from left to right.

The near-ear distance can be determined, for example, by the following calculation. FIG. 6 shows a plan view of the listener's head, together with the near area surrounding it. For the present purpose, we are interested in the front-right quadrant in order to derive an expression for the source to near-ear distance. The situation is trivial to resolve, as shown in FIG. 7, if the "true" source-to-ear paths for the close frontal positions (such as path "A") are assumed to be similar to the direct distance (indicated by "B"). This simplifies the situation, as is shown on the left diagram of FIG. 7, indicating a sound source S in the front-right quadrant, at an azimuth angle of θ degrees with respect to the listener. Also shown is the distance, d, of the sound source from the head centre, and the distance, p, of the sound source from the near-ear. The angle subtended by S-head_centre-Q' is (90°−θ). The near-ear distance can be derived using the cosine rule, from triangle S-head_centre-near_ear:

$$p^2=d^2+r^2-2dr.\cos 90-\theta|_{\theta=0}^{\theta=90} \tag{4}$$

If we assume the head radius, r, is 7.5 cm, then p is given by:

$$p=\sqrt{d^2+7.5^2-15d.\sin\theta}|_{\theta=0}^{\theta=90} \tag{5}$$

The far-ear distance can be determined, for example, by the following calculation. FIG. 8 shows a plan view of the listener's head, together with the near-field area surrounding it. Once again, we are particularly interested in the front-right quadrant. However, the path between the sound source and the far-ear comprises two serial elements, as is shown clearly in the right hand detail of FIG. 8. First, there is a direct path from the source, S, tangential to the head, labelled q, and second, there is a circumferential path around the head, C, from the tangent point to the far-ear. As before, the distance from the sound source to the centre of the head is d, and the head radius is r. The angle subtended by the tangent point and the head centre at the source is angle R.

The tangential path, q, can be calculated simply from the triangle:

$$q=\sqrt{d^2-r^2} \tag{6}$$

. . . and also the angle R:

$$R=\sin^{-1}\left(\frac{r}{d}\right) \tag{7}$$

Considering the triangle S-T-head_centre, the angle P-head_centre-T is (90−θ−R), and so the angle T-head_centre-Q (the angle subtended by the arc itself) must be (θ+R). The circumferential path can be calculated from this angle, and is:

$$C = \left\{\frac{\theta + R}{360}\right\} 2\pi r \tag{8}$$

Hence, by substituting (7) into (8), and combining with (6), an expression for the total distance (in cm) from sound source to far-ear for a 7.5 cm radius head can be calculated:

$$\text{Far-Ear Total Path} = \sqrt{|d^2 - 7.5^2|} + 2\pi r\left\{\frac{\theta + \sin^{-1}\left(\frac{7.5}{d}\right)}{360}\right\} \tag{9}$$

Now that working expressions for the distances to each ear from the sound source have been established, it is possible to derive an expression which defines the distance-dependent (and azimuth position-dependent) amount of crosstalk, relative to 100% (corresponding to equal transaural crosstalk signal and primary signal at low frequencies, as suitable for a distant source). As the source moves closer, the relative intensity between the ears decreases, and so there is relatively less crosstalk. This "crosstalk factor" (call it X) characterises the amount of transaural crosstalk relative to an infinitely distant source, where the near-ear and far-ear signals are virtually equal in amplitude at very low frequency (they tend to the same value at 0 Hz). Thus it is convenient to describe the crosstalk factor, which is the ratio of (far-ear/near-ear) intensities, as a fraction or percentage of this limiting, 100% value. This, in turn, would define how much attenuation should be applied to the crossfeed path in a transaural crosstalk cancellation system ("C" in FIG. 2) based on conventional "infinitely distant" A and S functions.

Alternatively, the crosstalk cancellation factor, X, could be converted into dB units of sound intensity, X(dB) and used to define the LF asymptote difference of an A and S function pair, as shown in FIG. 9, which could then be used in a conventional crosstalk cancellation scheme (for example FIG. 2, corresponding to Atal and Schroeder, U.S. Pat. No. 3,236,949) to the same effect. Thus the A function LF asymptote would be set so as to lie X(dB) below the S asymptote (because the far (A) ear is always more distant).

The crosstalk factor X is the far-ear LF intensity ($I_F$) expressed as a fraction of the near-ear LF intensity ($I_N$). The intensities are related to the distances from the source to far-ear ($D_F$) and near-ear ($D_N$) by the square law relationship (see Appendix), as follows.

$$\frac{I_F}{I_N} = \frac{D_N^2}{D_F^2} \tag{10}$$

From equation (5), the near-ear distance is:

$$D_N = \sqrt{d^2 + 7.5^2 - 5d.\sin\theta}\,\Big|_{\theta=0}^{\theta=90} \tag{11}$$

And from equation (9), the far-ear distance is:

$$D_F = \sqrt{|d^2 - 7.5^2|} + 15\pi\left\{\frac{\theta + \sin^{-1}\left(\frac{7.5}{d}\right)}{360}\right\} \tag{12}$$

Hence the crosstalk factor X (i.e. the LF intensity ratio), as a function of the distance from the source to the head centre, d, and source azimuth angle, θ, is as shown below in equation 13.

$$X = \frac{d^2 + |7.5|^2 - 15d \cdot \sin\theta\,\Big|_{\theta=0}^{\theta=90}}{\left(\sqrt{|d^2 - 7.5^2|} + 15\pi\left\{\frac{\theta\,\Big|_{\theta=0}^{\theta=90} + \sin^{-1}\left(\frac{7.5}{d}\right)}{360}\right\}\right)^2} \tag{13}$$

This can be expressed in dB in the usual manner, thus:

$$X_{dB} = 10\log X \tag{14}$$

It is worthwhile computing the X factor as a function of distance from the listener's head at various azimuth angles. This has been done in the range 10 degrees to 30 degrees, and is both tabulated in Table 1 below and depicted graphically in FIG. 10, where the X factor has been expressed as a fraction, according to equation 13.

TABLE 1 pq12813.xls AS 1 Jul. 98
Distance-Dependent Transaural Crosstalk Cancellation
(Head radius assumed to be 7.5 cm)

X Factor as a Ratio of Intensities (Far/Near)

<<- Speaker angle (deg) ->>

| d (cm) | 10 | 12 | 14 | 16 | 18 | 20 | 22 | 24 | 26 | 28 | 30 |
|---|---|---|---|---|---|---|---|---|---|---|---|
| 20 | 0.782 | 0.745 | 0.709 | 0.675 | 0.643 | 0.612 | 0.582 | 0.554 | 0.527 | 0.501 | 0.477 |
| 25 | 0.818 | 0.786 | 0.755 | 0.725 | 0.697 | 0.669 | 0.642 | 0.617 | 0.592 | 0.569 | 0.546 |
| 30 | 0.844 | 0.816 | 0.789 | 0.762 | 0.737 | 0.712 | 0.689 | 0.666 | 0.643 | 0.622 | 0.601 |
| 35 | 0.864 | 0.839 | 0.815 | 0.791 | 0.768 | 0.746 | 0.725 | 0.704 | 0.684 | 0.664 | 0.645 |
| 40 | 0.879 | 0.857 | 0.835 | 0.814 | 0.793 | 0.773 | 0.754 | 0.735 | 0.716 | 0.698 | 0.681 |
| 45 | 0.892 | 0.871 | 0.852 | 0.832 | 0.813 | 0.795 | 0.777 | 0.760 | 0.743 | 0.726 | 0.710 |
| 50 | 0.902 | 0.883 | 0.865 | 0.847 | 0.830 | 0.813 | 0.797 | 0.781 | 0.765 | 0.750 | 0.735 |
| 55 | 0.910 | 0.893 | 0.876 | 0.860 | 0.844 | 0.828 | 0.813 | 0.798 | 0.784 | 0.769 | 0.755 |
| 60 | 0.917 | 0.901 | 0.886 | 0.871 | 0.856 | 0.841 | 0.827 | 0.813 | 0.799 | 0.786 | 0.773 |
| 65 | 0.923 | 0.908 | 0.894 | 0.880 | 0.866 | 0.852 | 0.839 | 0.826 | 0.813 | 0.801 | 0.789 |
| 70 | 0.928 | 0.915 | 0.901 | 0.888 | 0.875 | 0.862 | 0.850 | 0.837 | 0.825 | 0.814 | 0.802 |
| 75 | 0.933 | 0.920 | 0.907 | 0.895 | 0.883 | 0.871 | 0.859 | 0.847 | 0.836 | 0.825 | 0.814 |
| 80 | 0.937 | 0.925 | 0.913 | 0.901 | 0.890 | 0.878 | 0.867 | 0.856 | 0.845 | 0.835 | 0.824 |
| 85 | 0.940 | 0.929 | 0.918 | 0.907 | 0.896 | 0.885 | 0.874 | 0.864 | 0.854 | 0.844 | 0.834 |
| 90 | 0.944 | 0.933 | 0.922 | 0.912 | 0.901 | 0.891 | 0.881 | 0.871 | 0.861 | 0.852 | 0.842 |

TABLE 1-continued

| | pq12813.xls | | AS 1 Jul. 98 Distance-Dependent Transaural Crosstalk Cancellation (Head radius assumed to be 7.5 cm) | | | | | | | | |
|---|---|---|---|---|---|---|---|---|---|---|---|
| 95 | 0.947 | 0.936 | 0.926 | 0.916 | 0.906 | 0.896 | 0.887 | 0.877 | 0.868 | 0.859 | 0.850 |
| 100 | 0.949 | 0.939 | 0.930 | 0.920 | 0.911 | 0.901 | 0.892 | 0.883 | 0.874 | 0.866 | 0.857 |
| 250 | 0.979 | 0.975 | 0.971 | 0.967 | 0.963 | 0.959 | 0.955 | 0.952 | 0.948 | 0.944 | 0.940 |

X Factor in dB

<<- Speaker angle (deg) ->>

| d (cm) | 10 | 12 | 14 | 16 | 18 | 20 | 22 | 24 | 26 | 28 | 30 |
|---|---|---|---|---|---|---|---|---|---|---|---|
| 20 | −1.067 | −1.279 | −1.491 | −1.704 | −1.919 | −2.134 | −2.349 | −2.566 | −2.783 | −3.001 | −3.219 |
| 25 | −0.872 | −1.046 | −1.220 | −1.395 | −1.570 | −1.746 | −1.922 | −2.098 | −2.274 | −2.449 | −2.625 |
| 30 | −0.736 | −0.883 | −1.030 | −1.178 | −1.325 | −1.473 | −1.621 | −1.768 | −1.915 | −2.062 | −2.208 |
| 35 | −0.635 | −0.763 | −0.890 | −1.017 | −1.144 | −1.272 | −1.399 | −1.525 | −1.651 | −1.777 | −1.902 |
| 40 | −0.559 | −0.671 | −0.783 | −0.894 | −1.006 | −1.118 | −1.229 | −1.340 | −1.450 | −1.560 | −1.670 |
| 45 | −0.499 | −0.598 | −0.698 | −0.798 | −0.897 | −0.996 | −1.095 | −1.194 | −1.292 | −1.390 | −1.487 |
| 50 | −0.450 | −0.540 | −0.630 | −0.719 | −0.809 | −0.898 | −0.987 | −1.076 | −1.164 | −1.252 | −1.339 |
| 55 | −0.410 | −0.492 | −0.573 | −0.655 | −0.737 | −0.818 | −0.899 | −0.979 | −1.060 | −1.139 | −1.218 |
| 60 | −0.376 | −0.451 | −0.526 | −0.601 | −0.676 | −0.750 | −0.825 | −0.898 | −0.972 | −1.045 | −1.117 |
| 65 | −0.348 | −0.417 | −0.486 | −0.555 | −0.624 | −0.693 | −0.762 | −0.830 | −0.897 | −0.965 | −1.032 |
| 70 | −0.323 | −0.387 | −0.452 | −0.516 | −0.580 | −0.644 | −0.708 | −0.771 | −0.834 | −0.896 | −0.958 |
| 75 | −0.302 | −0.362 | −0.422 | −0.482 | −0.542 | −0.601 | −0.661 | −0.720 | −0.778 | −0.836 | −0.894 |
| 80 | −0.283 | −0.339 | −0.396 | −0.452 | −0.508 | −0.564 | −0.619 | −0.675 | −0.730 | −0.784 | −0.838 |
| 85 | −0.266 | −0.320 | −0.373 | −0.426 | −0.478 | −0.531 | −0.583 | −0.635 | −0.687 | −0.738 | −0.789 |
| 90 | −0.252 | −0.302 | −0.352 | −0.402 | −0.452 | −0.501 | −0.551 | −0.600 | −0.649 | −0.697 | −0.745 |
| 95 | −0.239 | −0.286 | −0.334 | −0.381 | −0.428 | −0.475 | −0.522 | −0.568 | −0.614 | −0.660 | −0.706 |
| 100 | −0.227 | −0.272 | −0.317 | −0.362 | −0.407 | −0.451 | −0.496 | −0.540 | −0.584 | −0.627 | −0.670 |
| 250 | −0.091 | −0.109 | −0.127 | −0.145 | −0.163 | −0.180 | −0.198 | −0.216 | −0.233 | −0.250 | −0.267 |

From Table 1, the optimal X values for transaural crosstalk cancellation schemes applicable to, say, (a) a hi-fi system, (b) a desktop PC, and (c) a laptop PC can be ascertained, as tabulated below in Table 2.

TABLE 2

| | Speaker Distance (m) | Speaker Angle | X Factor | X (dB) |
|---|---|---|---|---|
| hi-fi System | 2.5 | 30° | 0.940 | −0.267 |
| Desktop PC | 0.6 | 30° | 0.773 | −1.117 |
| Laptop PC | 0.3 | 15° | 0.789 | −1.030 |

The implementation of the invention is straightforward: the transaural crosstalk cancellation factor X is incorporated into the filter design procedure, thus allowing a range of different transaural crosstalk cancellation filters to be created from standard low frequency convergent A and S functions, but with differing values of X, for a range of speaker configurations, such that the end user can select the most appropriate one for their particular speaker configuration. For example, after inspection of the data shown in Table 1 it would be reasonable to create a range of filters for X values in the range, say, 0.5 to 1.0 in 0.05 increments. These 11 filters would cover most situations.

This is very convenient, because Microsoft's new Windows98 (trademark) operating system includes the provision to select about a dozen different loudspeaker set-ups. The present invention would fit into this system easily, allowing the user to specify (a) the separation between speakers, and (b) the distance from head to speaker centre-line, for example, and then the software could select the optimal transaural crosstalk filtering arrangements.

In principle, as an alternative to the above method, it is possible to make A and S measurements at differing distances, say 1 meter, 0.9 meter, 0.8 meter and so on and create different crosstalk filters for these differing distances and for different loudspeaker configurations. This would "build-in" the correct amount of transaural crosstalk cancellation. However, the same problems would exist in attempting to work out what exactly the low-frequency characteristics of A and S were. Also, as already noted above, such close measurements are compromised by the loudspeaker diaphragm dimensions which depart from point-source properties at these distances, and so it is not possible to make accurate measurements closer than about 0.8 meter.

A further disadvantage of this alternative approach is that it would require many measurements at different distances and angles, and would result in quantised-distance effects: an optimum value could not be calculated and easily be provided for all loudspeaker configurations. The present invention allows both distance and angle parameters to be used to calculate a single crosstalk cancellation factor, from which an associated filter is selected, based on accurate, 1 meter measurement.

The above description has been related to loudspeakers which lie in the horizontal plane of the listener: this has been for illustrative purposes only, and the invention is not limited horizontal-plane loudspeaker configurations. The principles described above are equally applicable to loudspeakers which do not lie on the horizontal plane, and the equations may be re-formatted accordingly.

Appendix

Sound Intensity, I [Watts.m$^{-2}$]

The sound intensity, I, in a specified direction in a medium is defined as the sound energy transmitted per unit area per unit time. This represents the energy in an imaginary column, c, in length and with a unit cross-section. It can be shown that:

$$I = \frac{p_{RMS}^2}{Z} \quad (1)$$

where $p_{RMS}$ is the maximum pressure variation divided by the square root of two, and Z is the characteristic acoustic impedance of air, which is equal to the density of air times the velocity of sound in air. (Note that intensity, I, is proportional to the square of RMS pressure amplitude.)

Inverse Square Law

When sound is generated by a mechanical disturbance, the pressure fluctuations propagate away from the source in a spherical manner—the wavefront is just like an expanding "bubble". As the wave travels further and further from the source, the wavefront sphere increases in size, and hence its energy is spread over a larger surface area. Consequently, the energy density—and intensity—of the expanding wavefront diminishes.

Imagine that, at a particular time, the expanding sphere is relatively small, having radius $r_1$, such that $I_1$ represents the energy received per second from sound source s. Later in time, the wavefront has expanded to a larger sphere having radius $r_2$, and intensity $I_2$ at the surface. The total energy emanating from s is equal to the product of the area of the sphere and intensity at the surface of the sphere, and so, if no energy is lost:

$$4\pi.r_1^2 I_1 = 4\pi.r_2^2 I_2 \quad (2)$$

This rearranges to the "inverse square" relationship, as follows.

$$\frac{I_1}{I_2} = \frac{r_2^2}{r_1^2} \quad (3)$$

A consequence of this is, that the intensity of a sound source is inversely proportional to the square of the distance from the source. Also, it is worth noting the following.

(1) In practise, there is no such thing as a point source of sound, and the relationship is generally used for extended sources at a distance.

(2) Some energy is always lost because of friction in the medium, and so the sound intensity, I, falls off more rapidly than $1/r^2$.

What is claimed is:

1. A method of processing a plural channel audio signal including left and right channels, information in the channels representing a three dimensional sound-field for generation by respective left and right loudspeakers arranged at a distance from a preferred position of a listener in use, the method including:

a) choosing a distance between said loudspeakers and said preferred position;

b) determining, from a magnitude of the distance chosen, an optimal amount of transaural acoustic crosstalk compensation, said optimal amount being a function of the distance chosen; and c) applying said optimal amount of crosstalk compensation to said left and right channels.

2. A method as claimed in claim 1 further including choosing an angle between the left loudspeaker and the right loudspeaker as viewed from said preferred position, and determining from both said angle chosen and said distance chosen an optimal amount of transaural acoustic crosstalk compensation, said optimal amount being a function of both the angle chosen and the distance chosen.

3. A method as claimed in claim 1 in which the transaural acoustic crosstalk cancellation is achieved using a near ear response transfer function and a corresponding far ear response transfer function, each of which approach different respective valves at frequencies below 200 Hz.

4. A method as claimed in claim 1 in which the optimal amount of transaural acoustic crosstalk compensation is defined as $$X = \frac{d^2 + |7.5|^2 - 15d \cdot \sin\theta \,\Big|_{\theta=0}^{\theta=90}}{\left(\sqrt{|d^2 - 7.5^2|} + 15\pi\left\{\frac{\theta \,\Big|_{\theta=0}^{\theta=90} + \sin^{-1}\left(\frac{7.5}{d}\right)}{360}\right\}\right)^2}$$

where X is said compensation, d is said distance, and θ is a source azimuth angle.

5. Transaural acoustic crosstalk filter means being constructed and arranged for performing a method as claimed in claim 1.

6. An audio signal processed by a method as claimed in claim 1.

7. Apparatus for processing binaural signals for subsequent reproduction at an optimum region for a listener's head, comprising:

a left channel for receiving a left signal from a binaural pair of signals, including a branch node, a summing junction and a channel filter, and having an output coupled to reproducing or recording means;

a right channel for receiving a left signal from a binaural pair of signals, including a branch node, a summing junction and a channel filter, and having an output coupled to reproducing or recording means;

a first crossfeed transaural crosstalk cancellation channel connected between the branch node of the left channel and the summing junction of the right channel;

a second crossfeed transaural crosstalk cancellation channel connected between the branch node of the left channel and the summing junction of the right channel;

wherein each of said crossfeed transaural crosstalk cancellation channels includes a crossfeed filter and signal attenuation means, the left and right channels and the crossfeed transaural crosstalk cancellation channels being constructed and arranged relative to one another so that the signal attenuation of said signal attenuation means relative to the signals in the left and right channels is such that displacement, rotation, or displacement and rotation of a listener's head in use is permitted within said optimum region without significantly changing a binaural effect by the listener.

8. Apparatus for processing binaural signals, comprising:

a left channel for receiving a left signal from a binaural pair of signals, including a branch node, a summing junction and a channel filter having a transfer function G(x, A, S), and having an output coupled to reproducing or recording means;

a right channel for receiving a right signal from a binaural pair of signals, including a branch node, a summing junction and a channel filter having a transfer function G(x, A, S), and having an output coupled to reproducing or recording means;

a first crossfeed channel connected between the branch node of the left channel and the summing junction of the right channel; and a second crossfeed channel connected between the branch node of the left channel and the summing junction of the right channel;

wherein each of said crossfeed channels includes a crossfeed filter having a transfer function x(S/A) where A is a predetermined acoustic transmission function from a reproduction transducer to a far ear of a listener, S is a predetermined acoustic transmission function from a reproduction transducer to a near ear of a listener, x is a constant having a value of greater than zero and less than or equal to 0.95, and the transfer function G(x, A, S) of said channel filter is a function of x, A, and S so that, in use, there is produced an optimum region for locating the head of a listener, in which optimum region a significant amount of transaural acoustic crosstalk signals remain, thereby permitting displacement, rotation, or displacement and rotation of said head within said optimum region without significantly changing the binaural effect perceived by said listener.

* * * * *